US011333047B2

(12) United States Patent
Thevenod

(10) Patent No.: US 11,333,047 B2
(45) Date of Patent: May 17, 2022

(54) EXTERNAL HEAT SOURCE ENGINE WITH SLIDE VALVES

(71) Applicant: H2P SYSTEMS, Paris (FR)

(72) Inventor: Frederic Olivier Thevenod, Paris (FR)

(73) Assignee: H2P SYSTEMS, Paris (FR)

( * ) Notice: Subject to any disclaimer, the term of this patent is extended or adjusted under 35 U.S.C. 154(b) by 291 days.

(21) Appl. No.: 16/635,616

(22) PCT Filed: Aug. 2, 2018

(86) PCT No.: PCT/EP2018/071017
§ 371 (c)(1),
(2) Date: Jan. 31, 2020

(87) PCT Pub. No.: WO2019/025555
PCT Pub. Date: Feb. 7, 2019

(65) Prior Publication Data

US 2020/0240297 A1 Jul. 30, 2020

(30) Foreign Application Priority Data

Aug. 2, 2017 (FR) ..... 1757398

(51) Int. Cl.
*F01L 7/16* (2006.01)
*F02G 1/02* (2006.01)
(Continued)

(52) U.S. Cl.
CPC ..... *F01L 7/16* (2013.01); *F02G 1/02* (2013.01); *F01L 7/026* (2013.01); *F01L 7/18* (2013.01);
(Continued)

(58) Field of Classification Search
CPC ..... F01L 7/16; F01L 7/026; F01L 7/18; F01L 7/025; F02G 1/02; F02G 2242/10; F02G 2270/90; F02B 2075/027
See application file for complete search history.

(56) References Cited

U.S. PATENT DOCUMENTS 4,008,574 A * 2/1977 Rein ..... F02G 1/02 60/682
4,133,172 A * 1/1979 Cataldo ..... F02G 1/02 123/294
(Continued)

FOREIGN PATENT DOCUMENTS

| | | |
|---|---|---|
| EP | 2816013 A2 | 12/2014 |
| FR | 2905728 A1 | 3/2008 |
| FR | 2954799 A1 | 7/2011 |

*Primary Examiner* — Hung Q Nguyen
(74) *Attorney, Agent, or Firm* — BCF LLP

(57) ABSTRACT

The present invention concerns an external heat source engine comprising: —at least one cylinder (2), —a piston (3) that is movable back and forth in the cylinder, —a cylinder head (4) defining a working chamber (5) with the piston and the cylinder, —a heat exchanger (6) for exchanging heat between a working gas and a heat-transfer fluid, —a distribution comprising two rotary slide valves (20, 30) mounted so as to be able to rotate in the cylinder head and bringing the working chamber selectively into communication with the following resources: •a working gas inlet (A), •a cold end (B) of the exchanger, •a hot end (C) of the exchanger, •an exhaust (D). The slide valves (20, 30) comprise internal passages that open through the side wall of same through at least one opening that communicates selectively with the working chamber (5) via at least one opening formed in the cylinder head (4).

20 Claims, 6 Drawing Sheets

Figure 1A:
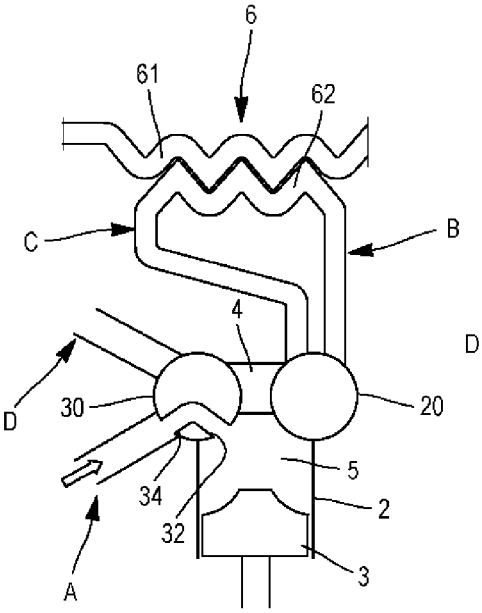

(51) Int. Cl.

| | |
|---|---|
| *F01L 7/02* | (2006.01) |
| *F01L 7/18* | (2006.01) |
| *F02B 75/02* | (2006.01) |

(52) U.S. Cl.
CPC .... *F02B 2075/027* (2013.01); *F02G 2242/10* (2013.01); *F02G 2270/90* (2013.01)

(56) References Cited

U.S. PATENT DOCUMENTS

| | | | |
|---|---|---|---|
| 2006/0213207 | A1 | 9/2006 | Redlich |
| 2008/0148731 | A1 | 6/2008 | Cao |

* cited by examiner

EXTERNAL HEAT SOURCE ENGINE WITH SLIDE VALVES

CROSS-REFERENCE TO RELATED APPLICATIONS

This application is a national phase filing under 35 U.S.C. § 371 of International Application No. PCT/EP2018/071017 filed on Aug. 2, 2018, which claims benefit of priority from French Patent Application No. 1757398 filed Aug. 2, 2017, the contents of which are hereby incorporated by reference in their entirety.

TECHNICAL FIELD

The present invention concerns an external hot source engine.

STATE OF THE PRIOR ART

Engines with an external hot source, for example of the Ericsson type, are experiencing renewed interest and development, with the purpose of reducing pollutant emissions or reducing energy consumption by upgrading heat emissions. This type of engine operates between two heat sources external to the engine via exchangers. It uses valves to control the flow of the working fluid (in the gas phase) between two chambers, one for compression and the other for expansion.

For volumetric machines such as in particular internal combustion piston engines, the distributions using valves actuated by cams are also known. This type of distribution has various limitations. Particularly, the pressure on the face of the valve opposite the working chamber must be low. Furthermore, the maximum valve lift is low if the duration (measured in degrees of cam rotation angle) of the valve opening is short. Furthermore, the cam drive consumes energy.

Volumetric machines are also known, such as compressors, which use a flap distribution. This solution requires that the pressure differential on each flap always has, at each stage of the machine operating cycle, an appropriate value and direction so that the flap is in the—open or closed—state necessary to the considered stage of the cycle.

In some volumetric machines with an external hot source, such as those described in the two patent applications FR 2 905 728 and FR 2 954 799, the working gas is compressed in a working chamber, then transferred in a hot source, and from there re-transferred to the same working chamber at the beginning of an expansion time of this chamber. To be effective, both aforementioned working gas transfers must be brief and take place through a passage section which is large enough to minimize the pressure drops. These requirements are difficult to meet with a distribution by flaps controlled by cams. Moreover, this type of cycle is hardly compatible with flap distribution.

The purpose of the present invention is to propose an external hot source engine to overcome at least part of the problems mentioned above. It also has the purpose of providing a space-saving engine.

DISCLOSURE OF THE INVENTION

According to a first aspect of the invention, at least one of the objectives is achieved with an external hot source engine comprising:

at least one cylinder, a piston moving back and forth in the cylinder, a cylinder head defining, with the piston and the cylinder, a working chamber for a working gas, a distribution mounted in the cylinder head and selectively communicating the working chamber with the following resources:

a working gas intake, a cold end of a heat exchanger, a hot end of the heat exchanger, an exhaust.

According to the invention, the distribution comprises at least one rotary slide valve mounted in rotation in the cylinder head and includes internal passages opening through the side wall thereof by at least one hole which selectively communicates with the working chamber by at least one opening made in the cylinder head.

The engine according to the invention has the advantage, compared with devices including valves, of distributing gas flows with little pressure drop, via large passage sections for very short instants. Compared to an engine implementing an ERICSSON cycle, the engine according to the invention allows significantly dividing the friction and the pressure drops. It allows improving engine efficiency while reducing the number of parts and thus the space requirement and weight of the engine.

A slide valve means a cylindrical element comprising internal passages in which the working gas can circulate. An internal passage is for example a conduit. The slide valve is disposed so that the axis of rotation thereof is perpendicular to the axis of the cylinder above which it is arranged. The slide valve is located between the working chamber and the exchanger along the working gas path. The rotary movement of the slide valve is synchronized with the reciprocating movement of the piston, so that the working gas can pass through the slide valve via the internal passages, and thus distribute the gas between the working chamber and the exchanger. Preferably, each internal passage communicates with at least two apertures formed through the side wall of the slide valve, each aperture being located at one of the two ends of the internal passage. At a certain stage of the cycle, the working gas flows between the working chamber and the cold inlet of the exchanger passing through at least one cylinder head opening and at least one internal passage of the rotating slide valve. An aperture in the slide valve which selectively coincides with at least one opening formed in the cylinder head is called hole.

The slide valve distribution system allows proposing a large section for the passage of the working gas, in particular as soon as a hole begins to coincide with a cylinder head opening. Since the speed of rotation of the slide valve is substantially constant, the passage section increases rapidly, for example linearly, until the hole coincides perfectly with the cylinder head opening. On the contrary, by its (substantially ovoid) geometry, a cam actuates a valve according to a substantially sinusoidal law so that the working gas passage section increases very slowly at the beginning of the opening movement.

The slide valve distribution allows carrying out the following four-stroke-type thermodynamic cycle:

a working gas, substantially cold, is taken into the working chamber, said gas is compressed in said working chamber, then transferred in the exchanger in which circulates a heat yielding fluid (the hot source), so as to heat the working gas;

the heated working gas is re-transferred in the working chamber at the beginning of an expansion time of the same working chamber; then the expansion continues and ends while the working chamber is isolated from the exchanger; and the working gas is exhausted from the working chamber.

Thanks to the slide valve, both aforementioned transfers of the working gas are brief and take place through a passage section large enough to minimize the pressure drops.

Preferably, at least one opening of the cylinder head is capable of communicating with two internal passages of the slide valve which open through the side wall of the slide valve by two circumferentially aligned holes. The angular deviation between the two neighboring holes is comprised between 5 and 15 degrees. These values, like the angular values given below, concerning the holes and the orifices, are indicated for a speed of rotation of the slide valve comprised between 3000 and 4000 rpm (revolutions per minute) and a temperature of the heat yielding fluid comprised between 500° C. and 600° C. (degrees Celsius). Said two internal passages are, one, is a passage through which the working gas enters in the working chamber, and the other, is a passage through which the working gas leaves the working chamber. This characteristic allows a working gas leaving the working chamber, and a working gas entering the working chamber, to intersect each other. Thus an unfavorable phenomenon of relatively low pressure in the working chamber at the beginning of the expansion phase is avoided.

For example, the slide valve comprises:

an internal passage intended to circulate the cold and compressed working gas between the working chamber and the cold end of the exchanger, and an internal passage, distinct from the previous one, intended to circulate the compressed and heated working gas, between the hot end of the exchanger and the working chamber.

The working gas entering the exchanger is called "cold" working gas by comparison with the higher temperature thereof when it leaves "hot" from the exchanger. It should however be understood that the "cold" working gas entering the exchanger is already reheated by its compression in the working chamber. Likewise, the "cold" end of the exchanger is still at a temperature close to that of the working gas at the end of compression.

Preferably, the distribution is arranged so that, at the end of the compression, the working chamber begins to communicate with the cold end of the exchanger when the pressure in the working chamber is lower than the pressure in the exchanger. During operation of the engine and with reference to the cycle described above, the working gas which is cold and compressed and/or being compressed enters in the rotating slide valve as soon as at least a portion of the hole coincides with the opening so as to circulate the cold and compressed working gas to the cold end of the exchanger. The passage section between the working chamber and the hole increases with the rotation of the slide valve. When the hole of the slide valve coincides perfectly with the cylinder head opening, the passage section is maximum. The major portion, at least 50%, of the volume of the cold and compressed working gas then has passed through said hole. Then, due to the rotation of the slide valve and the end of compression, only a portion of the hole coincides with the opening, so as to circulate the remaining portion of the cold and compressed working gas to the cold end of the exchanger. Simultaneously, the passage section between the working chamber and the second hole, of the second internal passage, increases so that a portion of said hole coincides with the same opening. The working gas leaving the second hole, and therefore entering the working chamber, comes from the hot end of the exchanger after being heated. The working gas thus makes a loop passing through the same cylinder head opening but through different internal passages of the slide valve. This allows making said larger opening, and therefore further increasing the passage section provided to the gas to pass into and return from the exchanger. For a short time, the cold working gas and the hot working gas intersect each other.

In one embodiment, at the end opposite the holes, the internal passages open through the side wall of the slide valve by orifices which selectively communicate with fixed connectors according to the angular position of the slide valve. The orifices of the slide valve allow the working gas to flow from the internal passages of the slide valve to the connectors or from the connectors to the internal passages of the slide valve.

Preferably, for each internal passage, the geometry of the at least one slide valve is such that the orifice is capable of communicating with the corresponding connector when the hole communicates with the working chamber. This characteristic allows communicating the working chamber with the connectors, so as to circulate the working gas.

Said connectors comprise a cold connector communicating with the cold end of the exchanger and a hot connector communicating with the hot end of the exchanger. Said connectors comprise an intake connector communicating with the working gas intake and an exhaust connector communicating with the working gas exhaust.

For the above and for the rest of the request, the terms hole and orifice correspond to or qualify apertures made through the side wall of the slide valve. The term hole is used to qualify each aperture capable of communicating with the cylinder head opening for the passage of the working gas from the working chamber to the slide valve or vice versa. The term orifice is used to qualify each aperture capable of communicating with a connector for the passage of the working gas from the slide valve to the connector or vice versa. A hole cannot be used as an orifice and vice versa. For this purpose, on the side wall of the at least one slide valve, the at least one hole is axially offset relative to the at least one orifice.

According to one embodiment, the holes and orifices or apertures of the slide valve are only arranged through the side wall.

According to another embodiment, the holes and orifices or apertures of the slide valve can be, partly or only, arranged through the two axial faces of the slide valve.

According to a preferred embodiment, the engine comprises a low-pressure slide valve controlling the selective communication of the working chamber with the intake and the exhaust. The engine comprises a high-pressure slide valve controlling the selective communication of the working chamber with the hot and cold ends of the exchanger. This characteristic allows simplifying the construction of the engine by separating the flows called "high pressure" flows from the flows called "low pressure" flows and reducing the space requirement thereof. The slide valves can have identical or different diameters. Slide valves of identical diameter allow simplifying the construction of the engine. This embodiment also meets the concern of providing a relatively large section for the passage of gas going to and returning from the exchanger, since the gas then being compressed, the volume which must flow is smaller than at the intake and at the exhaust. However, a high-pressure slide valve with a larger diameter than the diameter of the low-pressure slide valve allows further enlarging the passage section of the internal passages, going to and returning from the exchanger.

Preferably, the engine comprises two fixed connectors, a connector called "high pressure" connector and a connector called "low pressure" connector. The high-pressure connector comprises a cold connector communicating with the cold end of the exchanger and a hot connector communicating with the hot end of the exchanger. The low-pressure connector comprises an intake connector and an exhaust connector.

According to a preferred embodiment, the thermodynamic cycle is carried out in a single cylinder. The cylinder head, surmounting the working chamber, supports the high-pressure slide valve and the low-pressure slide valve, which are disposed parallel to each other viewed parallel to the axis of the slide valve. The cylinder head has a general geometric shape evoking a triangle. It has a lower face and two curvilinear lateral faces whose upper ends meet.

The cylinder head has two concave and opposite lateral faces, each face being arranged to receive a cylindrical slide valve, by shape complementarity. Particularly, each lateral face has a circular-arc-shaped section substantially coaxial with the axis of the received slide valve. The openings are made in the lateral faces. Preferably, the openings are rectangular in shape to limit the pressure drops.

The cylinder head has a substantially planar lower face intended to be in contact with the engine liner. The lower face comprises a chamber aperture which defines the entrance to a transition cavity and which, during engine operation, extends the volume of the working chamber (similar in shape to the shape of the cylinder) viewed parallel to the axis of the slide valves. The transition cavity has a substantially triangular shape. Preferably, the piston head has a complementary shape to the shape of the transition cavity, so that the head can enter the transition cavity.

According to one embodiment, the at least one hole comprises two holes for a same internal passage, capable of simultaneously communicating with the working chamber, by two openings. Each hole can coincide with one opening. This characteristic is particularly advantageous in order to find a compromise between a large section for the passage of the working gas flow, limiting the pressure drop of said flow and limiting the working gas leaks between the slide valve and the cylinder head. This compromise is all the more important for the high-pressure slide valve.

For example, during the phase of compressing the working gas and during the conveying thereof to the cold end of the exchanger, the gas passes through the two holes of the high-pressure slide valve passing through the two openings of the cylinder head so that the flow is divided in two to pass through the two openings and the two holes, forming two flow lines. After the two holes, each flow line circulates in a conduit opening into a common conduit. The internal passage in fact has a Y-shape according to this particular embodiment.

Preferably, the openings and the holes have a rectangular shape to limit pressure drops.

In a preferable manner, at least one of the holes is subdivided by at least one mullion. This characteristic allows maintaining sealing devices, placed on the cylinder head, when the at least one hole passes in front of a cylinder head opening. The mullions can equip both the holes of the low-pressure slide valve and those of the high-pressure slide valve.

For the above and for the rest of the description, mullion means a bar provided to subdivide only the hole without protruding inside the slide valve (without subdividing the internal passage). It extends circumferentially to connect two longitudinal sides of a hole so as to extend the circumference of the slide valve.

According to another embodiment, which may be compatible with the previous embodiment, at least one passage comprises two passages leading in parallel to a same resource, capable of simultaneously communicating each with one respective opening of the cylinder head. This characteristic allows proposing a large working gas passage section.

For example, when the working gas coming from the hot end of the exchanger has returned, the working gas flow is divided into two flow lines, which circulate in two separate internal passages inside the slide valve. The two flow lines are divided before entering the two orifices of the slide valve and meet after leaving the two openings of the cylinder head.

Preferably, the shape of the sections and the route of the internal passages are made to promote the circulation of the working gas in specific directions, for example to promote the gas suction, in particular to avoid a compression effect in the slide valve. Furthermore, they are arranged to limit the differential pressures along each slide valve. This allows limiting the friction between the slide valve and the cylinder head and thus limit the risks of leakage of the working gas around the slide valve.

According to other embodiments, the external hot source engine can comprise several cylinders such as an internal combustion engine. For example, the engine may comprise at least two cylinders. In this case, it can comprise all or part of the characteristics described so far. The at least one slide valve may include two orifices aligned circumferentially to selectively communicate with a same connector, and which communicate each with a respective passage associated with a respective one of the cylinders. This characteristic allows reducing the space requirement of the slide valve and therefore the space requirement of the engine.

The orifices are for example 180 degree opposite one another and the internal passages upstream of said orifices are adjoining and have a common wall.

In the case of two or more cylinders, the slide valve is advantageously the same for all the cylinders which are disposed in line with each other.

Preferably, the engine comprises sealing devices for limiting gas leakage. The openings are surrounded by sealing devices to close the gap between the peripheral wall of the slide valve and an adjacent surface of the cylinder head all around each opening. The sealing device may comprise bars made of a material for dry friction, for example graphite. For example, the bars are disposed on the lateral faces of the cylinder head around the openings.

According to another aspect of the invention, which may be compatible with the first aspect, an engine drive assembly is provided comprising an engine according to one or more of the characteristics set out above and a heat exchanger having a heat receiving path extending between a cold end and a hot end selectively connected to the working chamber at the end of a compression phase and at the beginning of an expansion phase, respectively. The working gas circulates in the heat receiving path.

Preferably, the exchanger is of the countercurrent type. The heat exchanger comprises a heat yielding path traveled in one direction by a heat yielding fluid, a direction which is opposite to the direction of travel of the working gas in the heat receiving path. The heat yielding path is distinct from the heat receiving path.

According to one embodiment, the heat exchanger comprises a heat yielding path traveled by the exhaust gases of an internal combustion engine. According to another embodiment, the heat exchanger comprises a heat yielding path traveled by a fluid reheated with solar energy.

DESCRIPTION OF THE FIGURES AND EMBODIMENTS

Figure 1B:
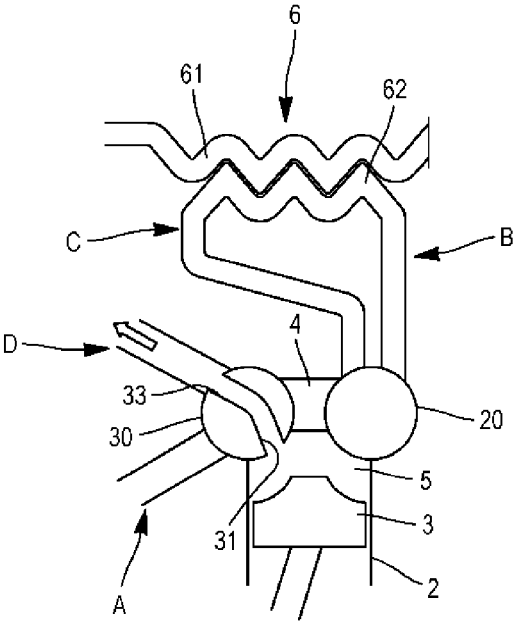
Figure 2A:
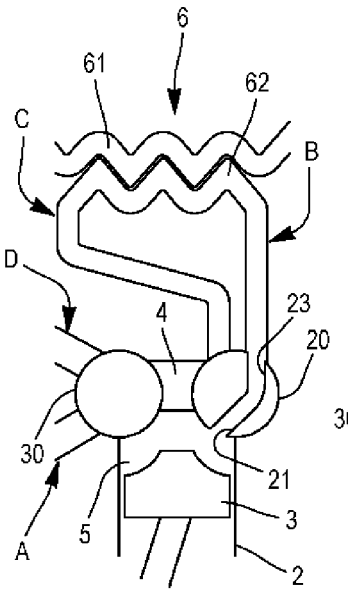
Figure 2B:
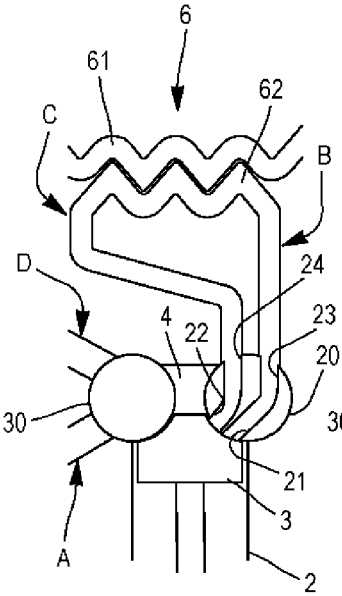
Figure 2C:
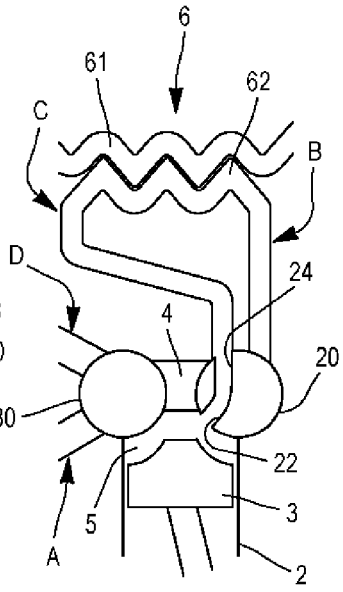
Figure 3:
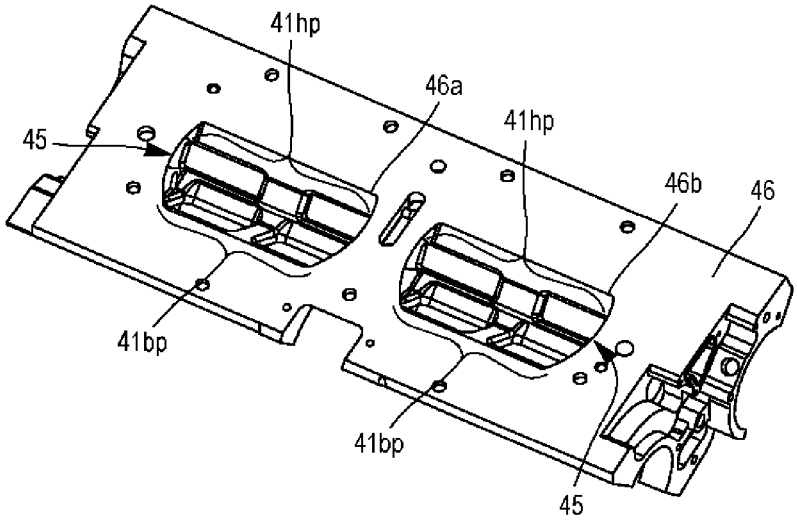
Figure 4:
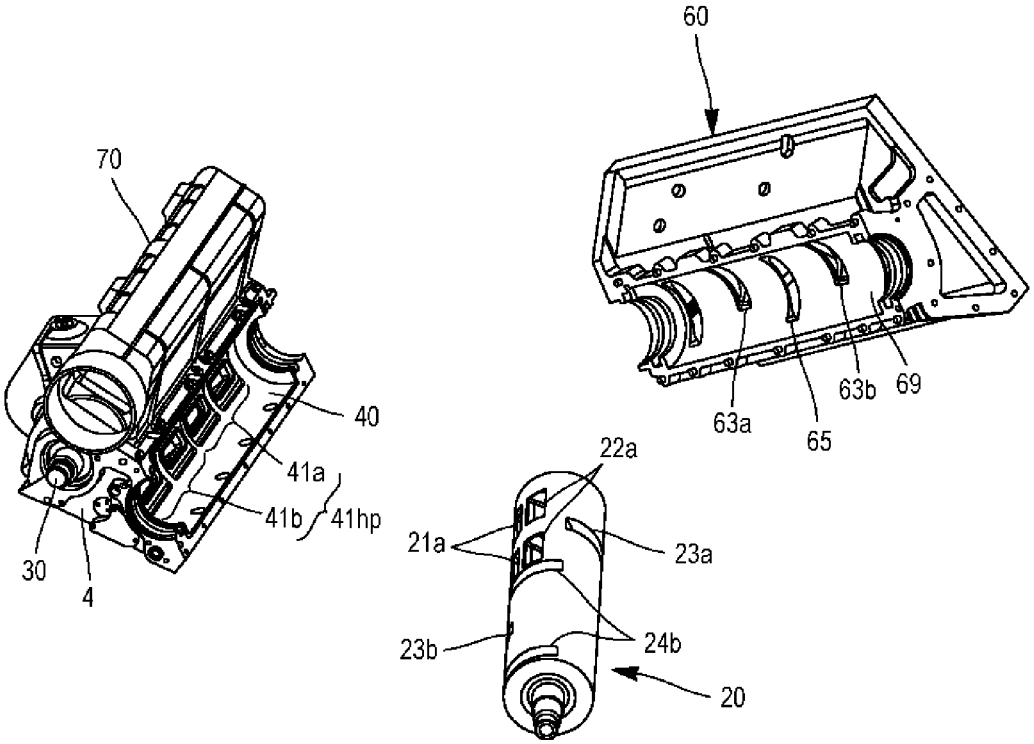
Figure 5A:
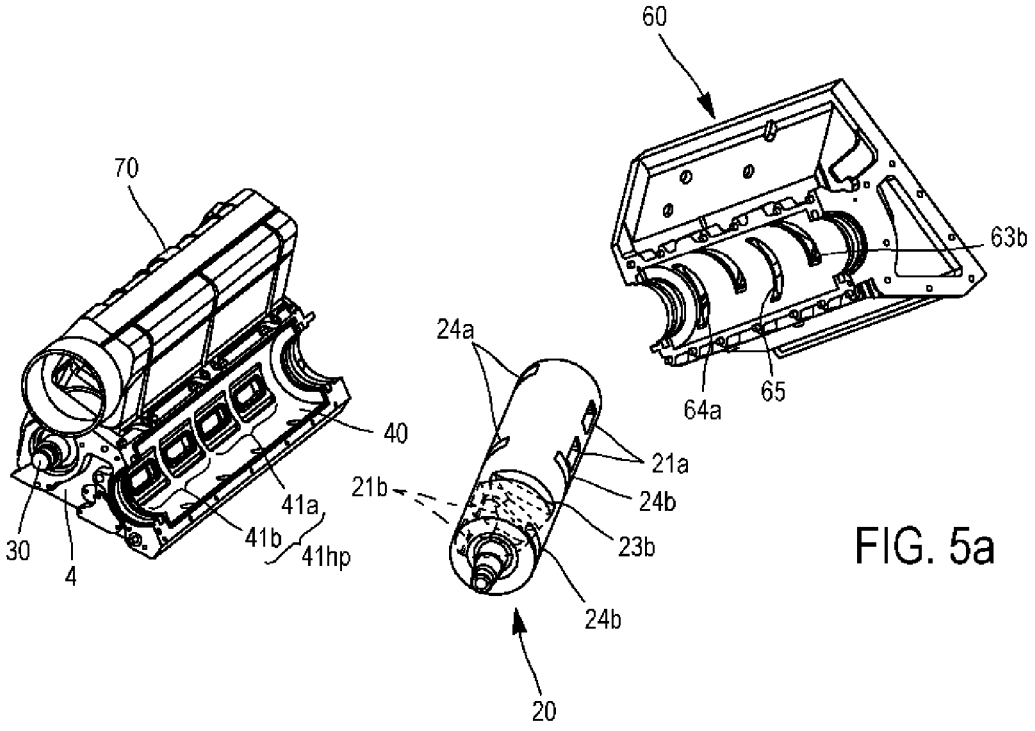
Figure 5B:
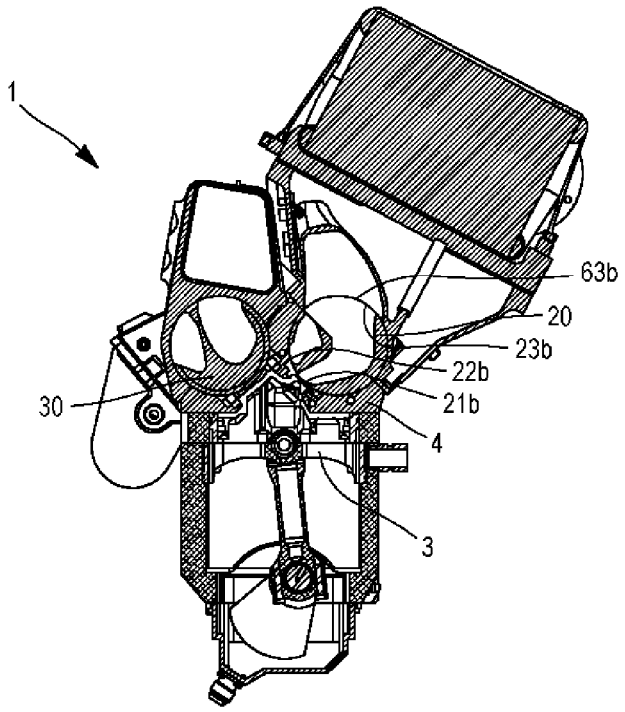
Figure 6A:
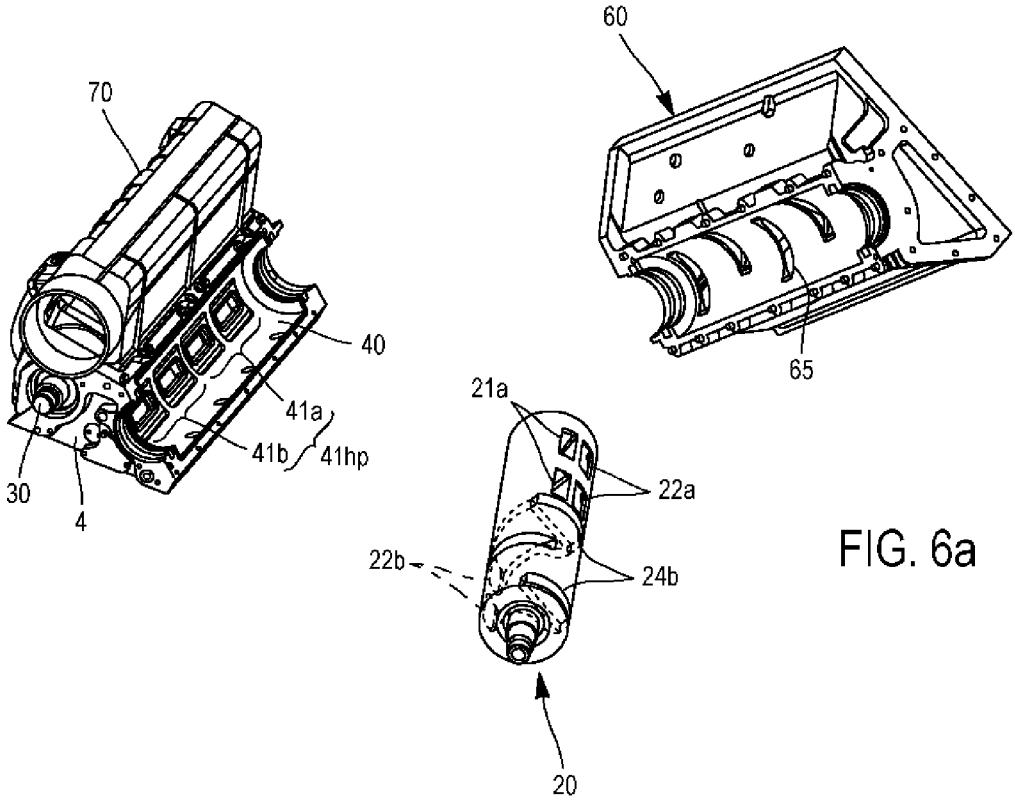
Figure 6B:
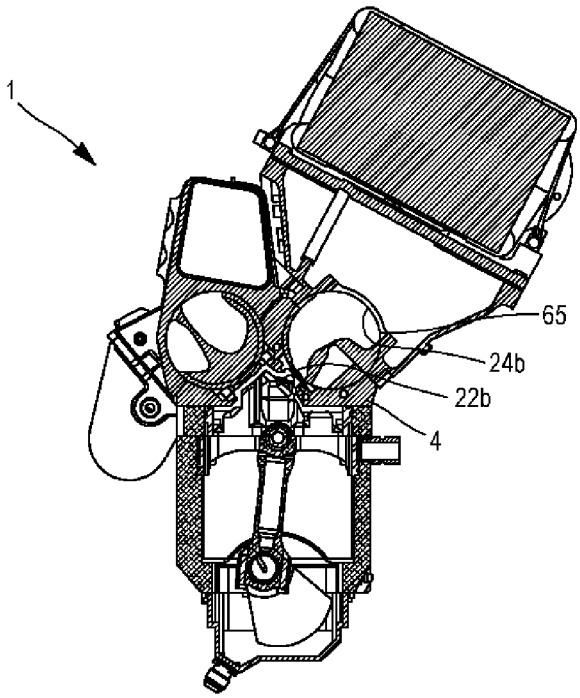
Figure 7A:
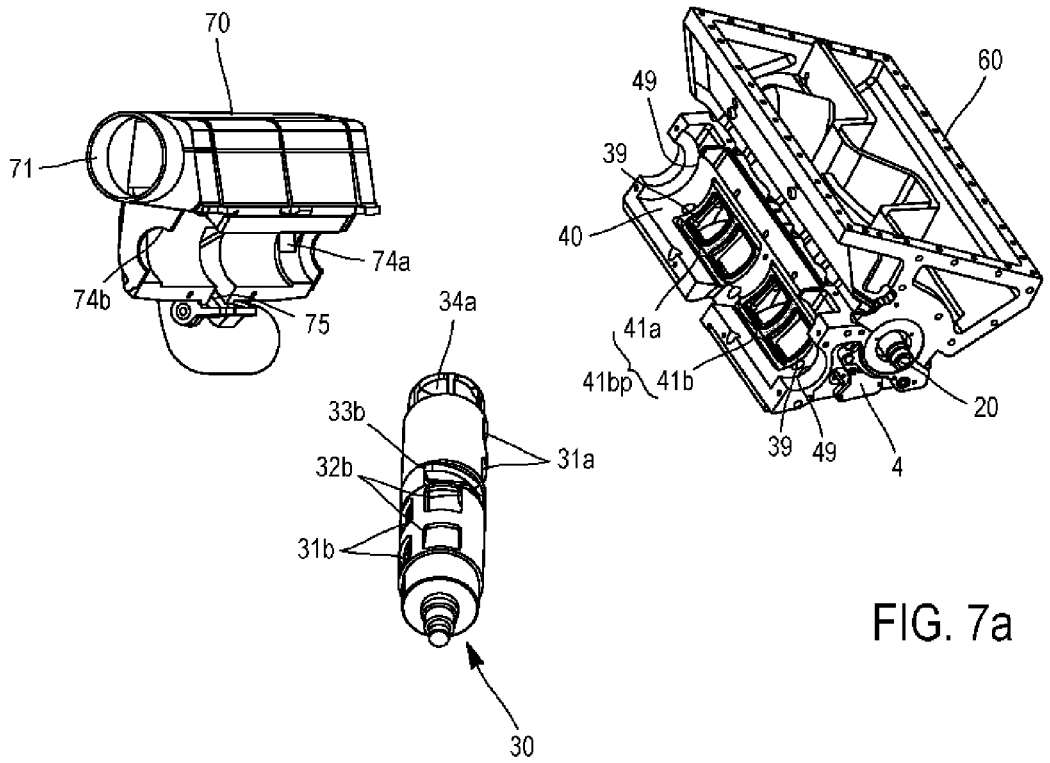
Figure 7B:
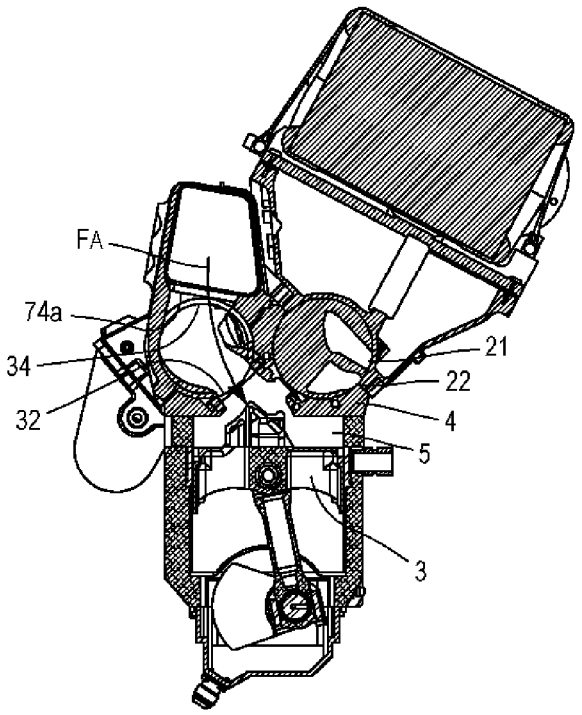
Figure 8A:
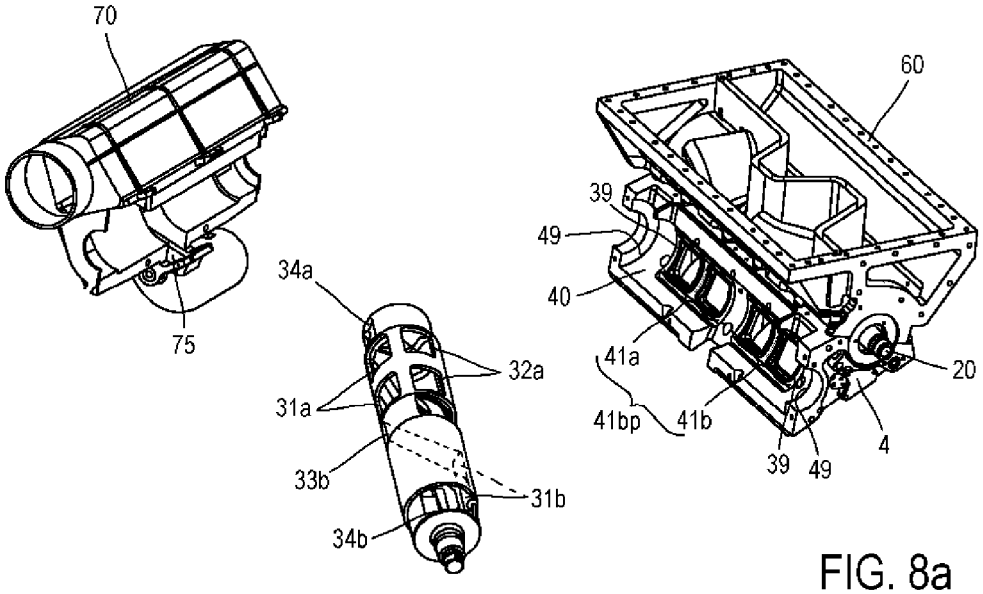
Figure 8B:
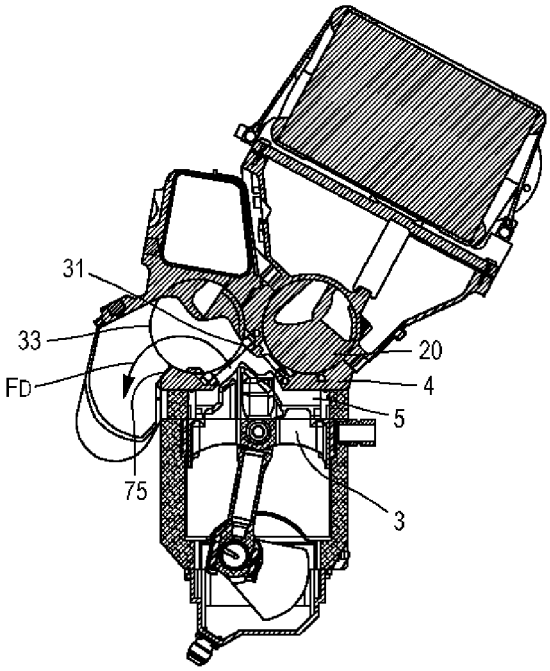

Other advantages and features of the invention will become apparent upon reading the detailed description of non-limiting implementations and embodiments, and of the following appended drawings:

FIGS. 1*a*, 1*b*, 2*a*, 2*b* and 2*c* are schematic representations of an external hot source engine, comprising two rotary slide valves according to the invention, the engine being coupled with a heat exchanger, the engine and exchanger assembly being viewed in cross section during the main operating phases of the engine: FIG. 1*a* illustrating a phase of taking a working gas into the cylinder of the engine, FIG. 1*b* illustrating a phase of exhausting gas from said cylinder, FIG. 2*a* illustrating a phase of end of compression of the working gas and during which the gas is also directed to a cold end of the heat exchanger, FIG. 2*b* illustrating a phase in which a slide valve has a position called "scanning" position which authorizes the simultaneous fluid communication of the cold end and the hot end of the exchanger with the engine cylinder, FIG. 2*c* illustrating a phase of expansion of the working gas after passing through the heat exchanger;

FIG. 3 is a bottom perspective view of a cylinder head, according to one embodiment, provided for an engine comprising two cylinders, the cylinder head having four openings for each cylinder;

FIG. 4 is an exploded perspective view of an upper portion of an engine, according to an embodiment comprising two cylinders, the upper portion comprising a cylinder head, in accordance with FIG. 3, carrying on the one hand a slide valve called "low-pressure" slide valve covered with a connector, and on the other hand a slide valve called "high-pressure" slide valve which is seen exploded between the cylinder head and a connector provided to cover the high-pressure slide valve;

FIGS. 5*a*, 5*b*, 6*a* and 6*b* are views showing the angular position of the slide valves before and after the phase illustrated by FIG. 2*b*, FIGS. 5*a* and 6*a* particularly illustrating the high-pressure slide valve, according to a representation mode similar to that of FIG. 4, FIGS. 5*b* and 6*b* being sectional views of an entire engine, FIGS. 5*a* and 5*b* illustrating the angular position of the high-pressure slide valve just before the scanning position and FIGS. 6*a* and 6*b* illustrating the angular position of the high-pressure slide valve immediately after the scanning position;

FIGS. 7*a* and 7*b* are views showing the angular position of the slide valves during the working gas intake phase illustrated by FIG. 1*a*, FIG. 7*a* is a perspective view of an upper portion of an engine, according to an embodiment comprising two cylinders, the upper portion comprising a cylinder head carrying on the one hand a high-pressure slide valve covered with a connector, and on the other hand a low-pressure slide valve which is seen exploded between the cylinder head and a connector provided to cover the low-pressure slide valve, FIG. 7*a* particularly illustrating the orientation of the low-pressure slide valve along the axis of rotation thereof, FIG. 7*b* being a sectional view of an entire engine;

FIGS. 8*a* and 8*b* are views showing the angular position of the slide valves during the working gas exhaust phase illustrated by FIG. 1*b*, FIG. 8*a* is a perspective view in accordance with FIG. 7*a* and illustrating the orientation of the low-pressure slide valve along the axis of rotation thereof, FIG. 8*b* being a sectional view of an entire engine.

As these embodiments are in no way limiting, it will in particular be possible to consider variants of the invention comprising only a selection of characteristics described below isolated from the other described characteristics (even if this selection is isolated within a sentence comprising these other characteristics), if this selection of characteristics is sufficient to confer a technical advantage or to differentiate the invention from the state of the prior art. This selection comprises at least one characteristic, preferably functional, without structural details, and/or with only part of the structural details if this part only is enough to confer a technical advantage or to differentiate the invention from the state of the art.

FIGS. 1*a*, 1*b*, 2*a*, 2*b* and 2*c* illustrate the main phases of operation of an external hot source engine 1, and will allow describing the engine, according to an embodiment comprising the essential characteristics. The engine comprises:

- an engine block in which a cylindrical cavity called cylinder 2 is formed,
- a movable piston 3 arranged to be displaced back and forth in the cylinder 2,
- a cylinder head 4 capping the engine block above the cylinder 2, a working chamber 5 being delimited for a working gas, typically air, in the cylinder 2 between the piston 3 and the cylinder head 4,
- a distribution mounted in the cylinder head 4, arranged and configured to selectively communicate the working chamber 5 with the following resources:
- a working gas intake A,
- a heat exchanger cold end B,
- a heat exchanger hot end C,
- an exhaust D.

The engine is connected to a heat exchanger 6 for a heat exchange between the working gas, said heat receiving fluid, and a heat yielding fluid. The heat exchanger 6 is of the countercurrent type. It comprises a heat yielding path 61 traveled by the heat yielding fluid from left to right. It further comprises a heat receiving path 62, shown under the heat yielding path 61, with reference to FIGS. 1*a* to 2*c*, so that the working gas travels the heat receiving path from right to left. The heat yielding path is distinct from the heat receiving path. The heat yielding fluid is for example the exhaust gases of an internal combustion engine.

The heat exchanger 6 is connected to the engine by means of connectors and pipes so as to be able to circulate the working gas from the engine to the exchanger and vice versa. Likewise, one or more connector(s) or pipe(s) are connected to the engine to make the intake and exhaust.

The distribution comprises two rotary slide valves 20, 30 mounted in rotation in the cylinder head 4, above the working chamber 5. The axes of rotation of the two slide valves are parallel to each other and orthogonal to the axis of the cylinder 2. The slide valves comprise a slide valve called "low pressure" slide valve 30 arranged and configured to control the selective communication of the working chamber 5 with the intake A and the exhaust D. The slide valves comprise a slide valve called "high pressure" slide valve 20 arranged and configured to control the selective communication of the working chamber 5 with the hot C and cold B ends of the exchanger 6. Preferably, the high-pressure slide valve is used only to control the working gas circulation between the working chamber and the exchanger. Likewise, the low-pressure slide valve is used only to control the intake and exhaust. This characteristic allows simplifying the construction of the engine by separating the flows called "high pressure" flows from the flows called "low pressure" flows and reducing the space requirement thereof. The slide valves have identical diameters allowing to simplify the construction of the engine.

Each slide valve 20, 30 comprises internal passages for conducting the working gas between the working chamber 5 and the resources. Each internal passage has two ends which open through the side wall of a slide valve each by at least one aperture. The distribution is arranged and configured so that the rotary movements of the slide valves are synchronized with the reciprocating movement of the piston, so that the working gas can pass through the slide valves via the internal passages. The apertures are arranged and configured to selectively coincide with at least one opening made in the cylinder head and at least one opening made in a fixed connector. The aperture facing the cylinder head opening when the working gas passes between the working chamber and the slide valve or vice versa is called the hole. The aperture facing a connector when the working gas passes between the slide valve and said connector or vice versa is called the orifice. A hole cannot be used as an orifice and vice versa. For this purpose, the orifices have an axial offset with the holes.

According to one embodiment of an engine comprising a single cylinder, the low-pressure slide valve comprises:

- for the intake A, an internal passage comprising an intake hole and an intake orifice,
- for the exhaust D, an internal passage comprising an exhaust hole and an exhaust orifice, and the high-pressure slide valve comprises:

- for the transfer of the working gas from the working chamber 5 to the cold end B of the exchanger 6, an internal passage comprising at least one cold hole and at least one cold orifice,
- for the transfer of the working gas from the hot end C of the exchanger 6 to the working chamber 5, an internal passage comprising at least one hot hole and at least one hot orifice.

The slide valve distribution allows carrying out the thermodynamic cycle the main phases of which will now be described.

With reference to FIG. 1*a*, the phase of taking a working gas into the working chamber 5 is illustrated. The synchronization of the piston 3 and the slide valves 20, 30 is such that the movement of the piston 3 is descending while the rotation of the low-pressure slide valve 30 allows an intake hole 32 of the low-pressure slide valve to communicate with a cylinder head opening and simultaneously allows an intake orifice 34 to communicate with an opening of an intake connector. The working gas passes through the internal passage between the intake orifice and the intake hole so as to be taken into the working chamber 5. At the same time, no hole of the high-pressure slide valve communicates with an opening of the cylinder head. The working gas is preferably air taken from the outside environment. When the piston has reached the bottom dead center, the low-pressure slide valve 30 has pivoted so that the intake hole 32 of the low-pressure slide valve no longer communicates, even partially, with a cylinder head opening (apart from any possible delay in closing the intake).

Then the piston rises so that the trapped working gas is compressed in the working chamber. With reference to FIG. 2*a*, a phase of end of compression of the working gas is illustrated. The synchronization of the piston 3 and the slide valves 20, 30 is such that the movement of the piston 3 is ascending while the rotation of the high-pressure slide valve 20 allows a cold hole 21 of the high-pressure slide valve to communicate with a cylinder head opening and simultaneously allows a cold orifice 23 to communicate with a connector opening of the cold end B of the exchanger 6. The working gas passes through the internal passage between the cold hole and the cold orifice so as to be transferred to the exchanger 6 to be heated. Simultaneously, no hole of the low-pressure slide valve communicates with a cylinder head opening. The synchronization of the high-pressure slide valve relative to the rise of the piston during a compression is adjusted so as to limit an unfavorable phenomenon of relatively high pressure in the working chamber.

With reference to FIG. 2*b*, the synchronization of the piston 3 and of the slide valves 20, 30 is such that the piston 3 is located in the top dead center while the rotation of the high-pressure slide valve 20 allows a dual working gas circulation inside the latter. The cold hole 21 of the high-pressure slide valve 20 coincides at least partially with the same cylinder head opening as previously, and simultaneously the cold orifice 23 coincides at least partially with the same connector opening of the cold end B of the exchanger 6, as previously. An internal passage called cold passage of the high-pressure slide valve allows the working gas to be transferred from the working chamber to the exchanger 6, via the cold end B. Furthermore, the synchronization allows a hot hole 22 to coincide at least partially with the same opening as for the cold hole 21, and simultaneously allows a hot orifice 24 to coincide at least partially with a connector opening of the hot end C of the exchanger 6. An internal passage called internal hot passage, distinct from the internal cold passage, allows the working gas to be transferred from the exchanger 6, via the hot end C, to the working chamber 5.

A communication between the cold end B and the hot end C of the exchanger is then established so that a portion of the incoming working gas and a portion of the outgoing working gas comes into contact. Working gas still passes through the internal passage between the cold hole and the cold orifice, and working gas passes through the internal passage between the hot orifice and the hot hole. The volume of gas previously compressed is in fact distributed in the path between the cold end B and the hot end C of the exchanger 6, the working gas being heated thanks to the heat yielding fluid present in the heat yielding path 61 of the exchanger 6. Simultaneously, no hole of the low-pressure slide valve communicates with a cylinder head opening.

Afterwards, the heated working gas leaving the high-pressure slide valve expands in the working chamber. With reference to FIG. 2*c*, the synchronization of the piston 3 and of the slide valves 20, 30 is such that the movement of the piston 3 is descending while the rotation of the high-pressure slide valve 20 allows the hot hole 22 of the high-pressure slide valve to communicate with the same cylinder head opening as previously and simultaneously allows a hot orifice 24 to communicate with the same opening, as previously, of a connector of the hot end C of the exchanger 6. The working gas passes through the internal passage between the hot orifice 24 and the hot hole 22 so as to be transferred from the exchanger 6 to the working chamber to be expanded. Simultaneously, no hole of the low-pressure slide valve communicates with a cylinder head opening. Once the piston has reached the bottom dead center, no hole of the high-pressure slide valve communicates with a cylinder head opening.

With reference to FIG. 1*b*, a working gas exhaust phase is illustrated. The synchronization of the piston 3 and the slide valves 20, 30 is such that the movement of the piston 3 is ascending while the rotation of the low-pressure slide valve 30 allows an exhaust hole 31 of the low-pressure slide valve to communicate with an opening of the cylinder head and simultaneously allows an exhaust orifice 33 to communicate with an opening of an exhaust connector. The working gas passes through the internal passage between the exhaust hole 31 and the exhaust orifice 33 so as to be expelled from the working chamber 5. Simultaneously, no hole of the high-pressure slide valve communicates with a cylinder head opening. The working gas is released into the outside environment. When the piston has reached the top dead center, the low-pressure slide valve has pivoted so that the exhaust hole 31 of the low-pressure slide valve no longer communicates, even partially, with a cylinder head opening (apart from any possible delay in closing the intake).

Preferably, the exhaust connector and the intake connector form a single part comprising at least one inlet for the intake and at least one outlet for the exhaust, each of the resources being transferred into a respective conduit. For the rest, an exhaust connector and/or an intake connector can indifferently be referred to a connector called "low pressure" connector.

Thanks to the slide valve, the transfers of the working gas are brief and take place through a passage section large enough to minimize the pressure drops. Furthermore, since the thermodynamic cycle can be carried out in a single cylinder, the engine has a very small space requirement compared to the external hot source engine of the prior art.

A specific embodiment will now be described, which will be described in these differences with the above embodiment. According to one embodiment, an external hot source engine comprising two cylinders is provided.

With reference to FIG. 3, which shows a cylinder head 4 arranged and configured to be installed on an external hot source engine comprising two cylinders disposed according to a mounting called "in-line" mounting.

The cylinder head 4 is then provided to surmount an engine block in which two cylinders are formed. It has a lower face 46 and two lateral faces (not visible in FIG. 3) provided to support respectively the high-pressure slide valve and the low-pressure slide valve, which are arranged parallel to each other.

The lower face 46 is substantially planar and is intended to be in contact with the engine liner. It comprises two chamber apertures 46*a*, 46*b*, each chamber aperture being provided to coincide with a cylinder of the engine. Each chamber aperture 46*a*, 46*b* defines an entrance to a transition cavity 45 hollowed inside the cylinder head. The transition cavity 45 has a substantially triangular shape and is, in operation, opposite the working chamber. Preferably, the piston head has a complementary shape to the shape of the transition cavity, so that the head can enter the transition cavity. When the engine is in operation, the volume of the cavity extends the volume of the working chamber.

According to the embodiment represented by FIG. 3, the cylinder head comprises eight openings, four openings being provided per cylinder (four on the left portion and four on the right portion of FIG. 3) for circulating the working gas according to the operating phases described above.

For one cylinder, two openings called "high-pressure" openings 41*hp* are provided for circulating the gas to the high-pressure slide valve and vice versa, and two openings called "low-pressure" openings 41*bp* are provided for circulating the working gas to the low-pressure slide valve and vice versa. The high-pressure openings 41*hp* are made on a same first lateral face of the cylinder head. The low-pressure openings 41*bp* are made on a same lateral face of the cylinder head opposite the first face; the four openings opening into a transition cavity.

With reference to FIG. 4, which shows a high engine arranged and configured to be installed on a liner of an external hot source engine comprising two cylinders disposed according to a mounting called "in-line" mounting. The high engine comprises a cylinder head 4, in accordance with FIG. 3, on which is mounted a low-pressure slide valve 30, only one end of which is visible in FIG. 4. The low-pressure slide valve is covered with a low-pressure connector 70 which will be described in more detail below. The cylinder head 4 has on a lateral face a receiving surface 40 on which a rotary slide valve, here the high-pressure slide valve 20, can be received.

The receiving surface 40 has a concave shape, so as to cooperate by shape complementarity with the high-pressure slide valve 20. Particularly, the receiving surface has a circular-arc-shaped section substantially coaxial with the axis of the received slide valve. The arrangement of the cylinder head 4 is substantially symmetrical as regards the shape of the lateral faces. The high-pressure slide valve like the low-pressure slide valve has, according to a cross section, a circular external shape. Furthermore, the two slide valves have a substantially identical diameter.

According to the embodiment shown in FIG. 4, the receiving surface 40 comprises four high-pressure openings 41*hp*: two pairs of adjacent openings 41*a*, 41*b*, each pair being provided to cooperate with one cylinder. Preferably, the openings are rectangular in shape to limit the pressure drops during the circulation of the working gas flow.

FIG. 4 shows the high-pressure slide valve in a particular angular position when the synchronization of the engine is such that:

- for one of the cylinders, called "cylinder a", the working gas undergoes a compression phase, and
- for the other cylinder, called "cylinder b", the working gas undergoes an expansion phase.

In this particular position, no working gas circulates in internal passages of the high-pressure slide valve 20.

With reference to FIGS. 4, 5*a*, 6*a*, the cylinder head 4 comprises two openings 41*a* provided to surmount the cylinder a, and two openings 41*b* provided to surmount the cylinder b. The high-pressure slide valve 20 comprises two adjacent cold holes 21*a*, of identical dimensions and aligned on the periphery of the slide valve, along a direction parallel to the axis of rotation of the slide valve. The cold holes have a substantially rectangular shape the longitudinal dimension of which extends in a direction which is parallel to the axis of rotation of the slide valve. The cold holes 21*a* are intended to coincide with the openings 41*a* of the cylinder head so that the working gas can circulate from the working chamber of the cylinder a to the high-pressure slide valve 20. At the other end of the internal passage and with reference in FIG. 4, there is a cold orifice 23*a* arranged at the periphery of the high-pressure slide valve. The two cold holes 21*a* on the one hand, and the cold orifice 23*a* on the other hand, define respectively the two ends of the internal passage used to circulate the working gas to the cold end of the exchanger. The orifice 23*a* is intended to coincide with an opening 63*a* of the high-pressure connector 60. The orifice 23*a* has a rectangular shape the longitudinal dimension of which extends in a direction which is orthogonal to the axis of rotation of the slide valve.

Furthermore, the openings 41 are spaced from each other so that the orifices (cold and hot) are opposite the receiving surface 40 of the cylinder head 4 between two openings.

Preferably, the spacing between two transverse edges of two adjacent openings is equal to or greater than the transverse dimension of an orifice. The orifices are therefore dimensioned depending on the spacing between two openings, or on the spacing between one opening and the axial end of the receiving surface. Thus, for example, the cold orifice 23*a* is circumferentially aligned with the circumferential surface separating the two cold holes 21*a*.

With reference to FIG. 4, it can also be distinguished that the high-pressure slide valve comprises two adjacent hot holes 22*a*, of identical dimensions and aligned on the periphery of the slide valve, along a direction parallel to the axis of rotation of the slide valve. The hot holes have a substantially rectangular shape the longitudinal dimension of which extends in a direction which is parallel to the axis of rotation of the slide valve. The hot holes 22*a* are circumferentially aligned with the cold holes 21*a*. The hot holes 22*a* are intended to coincide with the openings 41*a* of the cylinder head so that the working gas can circulate from the high-pressure slide valve 20 to the working chamber of the cylinder a. Furthermore, the hot holes 22*a* and the cold holes 21*a* are spaced apart along the circumference of the slide valve with a very small angular displacement, for example 5 to 15 degrees. The angular displacement is selected so that an opening 41 can communicate simultaneously with a cold hole and a hot hole.

For example, each hot hole has, along the circumference of the slide valve, an angular aperture comprised between 20 and 50 degrees, preferably between 25 and 35 degrees. Given that the engine carries out four main phases and that the internal passages are separated by walls of non-zero thickness, these values are selected according to a compromise between the need for a large section for the passage of the working gas flow, the reduction of pressure drops and the space requirement (diameter and length of the slide valve). Each cold hole has, along the circumference of the slide valve, an angular aperture comprised, for example, between 10 and 40 degrees, preferably between 20 and 30 degrees.

Furthermore, each opening 41*hp* has, along the circumference of the receiving surface 40, an angular aperture comprised, for example, between 15 and 30 degrees.

Preferably, the orifices have, along the circumference of the slide valve, an angular aperture comprised between 100 and 350 degrees, preferably between 120 and 150 degrees.

Concerning the cylinder b and according to the particular angular position of the high-pressure slide valve, the synchronization of the engine is such that no hole communicates with the openings 41*b* of the cylinder head. With reference to FIG. 4, it can partly be distinguished that the high-pressure slide valve comprises a cold orifice 23*b* intended to coincide with an opening 63*b* of the high-pressure connector 60 so that the working gas coming from the working chamber of the cylinder b can circulate from the high-pressure slide valve to the high-pressure connector. It can also be distinguished that the high-pressure slide valve comprises two hot orifices 24*b* intended to communicate respectively with two openings of the high-pressure connector 60 so that the working gas coming from the hot end of the exchanger can circulate from the high-pressure connector (via two openings including one opening 65 and another opening not visible) to the high-pressure slide valve towards the working chamber of the cylinder b. The high-pressure connector 60 has a covering surface 69 arranged and configured to cooperate by shape complementarity with the peripheral surface that is left free by the cylinder head 4. The covering surface 69 has, in a cross section, a substantially circular arc shape.

Between the portion of the high-pressure slide valve selectively communicating with the cylinder a and the portion of the high-pressure slide valve selectively communicating with the cylinder b, the holes and orifices are respectively diametrically opposite.

The angular positions of the high-pressure slide valve 20 when the working gas circulates between the working chamber of the cylinder b and the exchanger will now be described with reference to FIGS. 5*a*, 5*b*, 6*a* and 6*b*. FIG. 5*a* shows the high-pressure slide valve in a particular angular position when the synchronization of the engine is such that:

- for the cylinder a, the working gas undergoes an exhaust phase, which will be described below, and
- for the cylinder b, the working gas which is compressed and/or being compressed is transferred to the cold end of the exchanger (also visible in FIG. 5*b*).

Referring to FIG. 5*a*, the high-pressure slide valve 20 comprises two cold holes 21*b* seen in transparency from the circumference of the slide valve and in accordance with the cold holes of FIG. 4. The two cold holes 21*b* form the entrance to the internal passage, also seen in transparency, until a cold orifice 23*b*. Said internal passage comprises two conduits extending respectively from a cold hole 21*b*, then the two conduits meet at a common conduit, thus forming the internal passage between the two cold holes 21*b* and the cold orifice 23*b*. The synchronization of the engine is such that the cold holes 21*b* communicate with the openings 41*b* of the cylinder head so that the working gas circulates from the working chamber of the cylinder b to the high-pressure slide valve, and simultaneously the cold orifice 23*b*, in accordance with the cold orifice of FIG. 4, communicates with the opening 63*b* of the high-pressure connector 60 so that the working gas circulates from the high-pressure slide valve to the high-pressure connector. With reference to FIG. 5*b*, the cold hole 21*b* coincides perfectly with the opening 41*b* of the cylinder head, and the cold orifice 23*b* coincides perfectly with the opening 63*b* of the high-pressure connector. The gas, which has been previously compressed in the working chamber by rising the piston 3, is pushed into the internal passage of the high-pressure slide valve 20.

Furthermore, one can also partially distinguish two hot orifices 24*a* intended to communicate respectively with two openings of the high-pressure connector 60 so that the working gas coming from the hot end of the exchanger can circulate from the high-pressure connector (via two openings, an opening 64*a* and an opening 65) to the high-pressure slide valve 20 towards the working chamber of the cylinder a.

With reference to FIGS. 6*a* and 6*b*, the angular position of the high-pressure slide valve is such that said slide valve has turned a few degrees in the counterclockwise direction, so that the working gas circulates from the hot end of the exchanger to the cylinder b working chamber. FIG. 6*a* shows the high-pressure slide valve in a particular angular position when the synchronization of the engine is such that:

- for the cylinder a, the working gas undergoes an end of exhaust phase, which will be described below, and
- for the cylinder b, the working gas leaves the hot end of the exchanger and is transferred to the working chamber of cylinder b to be expanded (also visible in FIG. 6*b*).

With reference to FIG. 6*a*, the high-pressure slide valve 20 comprises two hot orifices 24*b* in accordance with the orifices of FIG. 4. Each hot orifice 24*b* forms an entrance to an internal passage, seen in transparency from the circumference of the slide valve, until a hot hole 22*b*, the two hot holes also being seen in transparency from the periphery of the slide valve. Each internal passage conducts the working gas in parallel and communicates respectively and simultaneously with an opening of the cylinder head. The working gas flow is divided into two flow lines which circulate in two separate internal passages inside the slide valve. The two flow lines are divided before entering the two orifices 24*b* of the high-pressure slide valve and meet after leaving the two openings 41*b* of the cylinder head. This characteristic allows proposing a large section for the passage of the working gas flow.

The synchronization of the engine is such that the hot orifices 24*b* communicate with openings (the opening 65 and a second opening which is not visible) of the high-pressure connector 60 so that the working gas circulates from the hot end of the exchanger to the high-pressure slide valve 20, and simultaneously the hot holes 22*b*, in accordance with the hot holes of FIG. 4, communicate with the openings 41*b* of the cylinder head so that the working gas circulates from the high-pressure slide valve to the working chamber of the cylinder b. With reference to FIG. 6*b*, the hot hole 22*b* coincides perfectly with the opening 41*b* of the cylinder head, and the hot orifice 24*b* coincides perfectly with the opening 65 of the high-pressure connector 60. The gas, which has been previously heated in the exchanger, is expanded in the working chamber of the cylinder b so as to push the piston 3 in a downward movement.

During operation of the engine and with reference to the cycle described above, the working gas which is cold and compressed and/or being compressed enters the rotating high-pressure slide valve 20 as soon as at least a portion of the two cold holes 21*b* communicates with the openings 41*b* so as to circulate the cold and compressed working gas to the cold end of the exchanger. The passage section between the working chamber and the cold holes increases with the rotation of the high-pressure slide valve. When the cold holes of the high-pressure slide valve coincide perfectly with the cylinder head openings, the passage section is maximum. The major portion of the cold and compressed working gas volume has passed through said holes. Then, due to the rotation of the high-pressure slide valve and to the end of compression, only a portion of the holes communicates with the openings, so as to circulate the remaining portion of the cold and compressed working gas to the cold end of the exchanger. Simultaneously, the passage section between the working chamber and the hot holes increases so that a portion of said hot holes communicates with the same opening. The working gas leaving the hot holes, and therefore entering the working chamber, comes from the hot end of the exchanger after being heated. The working gas thus makes a loop passing through the same openings of the cylinder head but through different internal passages of the high-pressure slide valve. For a short time the cold working gas and the hot working gas intersect each other.

According to a particular embodiment of the high-pressure slide valve provided for an engine comprising two cylinders, the high-pressure slide valve 20 includes two orifices circumferentially aligned to selectively communicate with the high-pressure connector. With reference to FIG. 5*a*, one of the hot orifices 24*a*, provided for performing the communication of the working gas coming from the cylinder a, and one of the hot orifices 24*b*, provided for performing the communication of the working gas coming from the cylinder b, are circumferentially aligned. Said orifices are disposed substantially in the center of the slide valve and are 180 degrees opposite one another. The internal passages upstream of said orifices are adjoining and have a common wall. During the operation of the engine, each of said two orifices successively communicates an associated passage with an opening 65 of the high-pressure connector. This characteristic allows reducing the space requirement of the slide valve and therefore the space requirement of the engine.

The angular positions of the low-pressure slide valve 30 when the working gas circulates between the working chamber of one of the cylinders and a low-pressure connector 70 will now be described with reference to FIGS. 7*a*, 7*b*, 8*a* and 8*b*.

A high engine similar to FIGS. 4, 5*a* and 5*b* is shown with reference to FIGS. 7*a* and 8*a*. Only the low pressure portion of the high engine will be described since the high pressure portion of the high engine is identical to FIGS. 4, 5*a* and 5*b*. As for the high pressure portion, the lateral face accommodating the low-pressure slide valve has a receiving surface 40 comprising four low-pressure openings 41*bp*: two pairs of adjacent openings 41*a*, 41*b* being provided to cooperate respectively with a cylinder a and a cylinder b.

FIG. 7*a* shows the low-pressure slide valve in a particular angular position when the synchronization of the engine is such that:

for the cylinder a, working gas is taken into the working chamber (intake phase), and for the cylinder b, the working gas undergoes an expansion phase.

In this particular position, no working gas circulates in internal passages of the high-pressure slide valve.

With reference to FIGS. 7*a*, 8*a*, the cylinder head 4 comprises openings 41*a* provided to surmount the cylinder a, and openings 41*b* provided to surmount the cylinder b. The low-pressure slide valve 30 comprises two adjacent intake holes 32*a* (not visible in FIG. 7*a*), of identical dimensions and aligned on the periphery of the slide valve, along a direction parallel to the axis of rotation of the slide valve. The intake holes 32*a* have a substantially rectangular shape the longitudinal dimension of which extends in a direction which is parallel to the axis of rotation of the slide valve. According to the angular position shown by FIG. 7*a*, the intake holes 32*a* communicate with the two openings 41*a* of the cylinder head 4 so that the working gas circulates from the low-pressure slide valve 30 to the working chamber of the cylinder a. At the other end of the internal passage and with reference to FIGS. 7*a* and 7*b*, there is located an intake orifice 34*a* arranged at the periphery of the low-pressure slide valve (partially visible in FIG. 8*a*). The two intake holes 32*a* on the one hand, and the intake orifice 34*a* on the other hand, define respectively the two ends of the internal passage used to circulate the working gas from the low-pressure connector 70 to the working chamber of the cylinder a. According to the angular position shown, the intake orifice 34*a* communicates with an intake opening 74*a* of the low-pressure connector 70.

During operation, the outside air, serving as working gas, is introduced into the low-pressure connector via an intake inlet 71. The intake orifice 34*a* has a rectangular shape the longitudinal dimension of which extends in a direction which is orthogonal to axis of rotation of the slide valve.

With reference to FIG. 7*b*, an intake hole 32*a* coincides perfectly with an opening 41*a* of the cylinder head, and the intake orifice 34*a* coincides perfectly with the opening 74*a* of the low-pressure connector 70. The downward movement of the piston 3 allows the working gas intake, see arrow fA.

Furthermore, with reference to FIGS. 7*a* and 8*a*, each pair of openings 41*bp* is spaced from an axial end 49 of the receiving surface 40 so that the intake orifices are opposite the receiving surface 40 of the cylinder head 4 between an axial end 49 of the receiving surface 40 and a transverse edge 39 of an opening 41*bp* of the cylinder head. Preferably, the spacing between an axial end 49 of the receiving surface 40 and a transverse edge 39 is equal to or greater than the transverse dimension of an intake orifice.

With reference to FIGS. 7*a* and 8*a*, it can also be distinguished that the low-pressure slide valve 30 comprises two adjacent exhaust holes 31*a*, of identical dimensions and aligned on the periphery of the slide valve, along a direction parallel to the axis of rotation of the slide valve. The exhaust holes 31*a* have a substantially rectangular shape the longitudinal dimension of which extends in a direction which is parallel to the axis of rotation of the slide valve. The exhaust holes 31*a* are circumferentially aligned with the intake holes 32*a*. The exhaust holes 31*a* are intended to communicate with the openings 41*a* of the cylinder head so that the working gas can circulate from the working chamber of the cylinder a to the low-pressure slide valve 30 via an internal passage. At the opposite end of the exhaust holes 31*a*, the internal passage opens through an exhaust orifice 33*a*. Furthermore, the exhaust holes 31*a* and the intake holes 32*a* are spaced apart along the circumference of the slide valve by a small angular displacement, for example, from 100 to 350 degrees, preferably from 200 to 250 degrees.

Preferably, each exhaust hole has, along the circumference of the low-pressure slide valve, an angular aperture comprised between 70 and 100 degrees, preferably between 80 and 90 degrees. Furthermore, each intake hole has, along the circumference of the slide valve, an angular aperture comprised, for example, between 70 and 100 degrees, preferably between 80 and 90 degrees.

Furthermore, each opening 41*bp* has, along the circumference of the receiving surface 40, an angular aperture comprised, for example, between 40 and 100 degrees.

Preferably, the intake and exhaust orifices have, along the circumference of the slide valve, an angular aperture comprised between 30 and 60 degrees, preferably between 40 and 55 degrees.

Between the portion of the low-pressure slide valve selectively communicating with the cylinder a and the portion of the low-pressure slide valve selectively communicating with the cylinder b, the holes and orifices are respectively diametrically opposite according to the shown embodiment.

Concerning the cylinder b and according to the particular angular position of the low-pressure slide valve, the synchronization of the engine is such that no hole coincides with the openings 41*b* of the cylinder head. With reference to FIG. 7*a*, it can be distinguished that the low-pressure slide valve comprises two intake holes 32*b* intended to communicate with two openings 41*b* so that the working gas coming from the low-pressure connector 70 can circulate from the low-pressure slide valve (passing through an intake orifice 34*b* not visible in FIG. 7*a*) to the working chamber of the cylinder b. It is also partly distinguished that that the low-pressure slide valve 30 comprises two exhaust holes 31*b* intended to communicate respectively with the two openings 41*b* of the cylinder head 4 so that the working gas can circulate from the working chamber of the cylinder b to the low pressure connector 70. It is furthermore distinguished that the low-pressure slide valve 30 comprises an exhaust orifice 33*b*. The exhaust holes 31*b* on the one hand, and the exhaust orifice 33*b* on the other hand correspond to both ends of the internal passage allowing to circulate the working gas coming from the working chamber of the cylinder b to the low-pressure connector.

FIG. 8*a* particularly shows the angular position of the low-pressure slide valve 30 when the working gas is exhausted from the working chamber of the cylinder b. With reference to FIG. 8*a*, the two exhaust holes 31*b* of the low-pressure slide valve 30 are seen in transparency from the circumference of the slide valve and in accordance with the exhaust holes of FIG. 7*a*. Both exhaust holes 31*b* form the entrance to the internal passage, also seen in transparency, until the exhaust orifice 33*b*. The synchronization of the engine is such that the exhaust holes 31*b* communicate with the openings 41*b* of the cylinder head 4 so that the working gas circulates from the working chamber of the cylinder b to the low-pressure slide valve, and simultaneously the exhaust orifice 33*b*, in accordance with the exhaust orifice of FIG. 7*a*, communicates with the opening 75 of the low-pressure connector 70 so that the working gas circulates from the low-pressure slide valve to the low-pressure connector. With reference to FIG. 8*b*, the exhaust hole 31*b* coincides perfectly with the opening 41*b* of the cylinder head, and the exhaust orifice 33*b* coincides perfectly with the opening 75 of the low-pressure connector. The movement of the piston 3 is such that the working gas is pushed into the internal passage of the low-pressure slide valve 30 then to the low-pressure connector 70, see arrow fD.

With reference to FIGS. 7*a* and 8*a*, the exhaust orifices 33*a* and 33*b* are circumferentially aligned along the periphery of the low-pressure slide valve 30. Said orifices are for example 180 degree opposite one another and the internal passages upstream of said orifices are adjoining and have a common wall. During engine operation, each orifice successively communicates an associated internal passage with a single exhaust opening 75 of the low-pressure connector. This characteristic allows reducing the space requirement of the slide valve and therefore the space requirement of the engine.

Furthermore, each pair of openings 41*bp* is spaced from one another along the receiving surface 40 so that the exhaust orifices are opposite the receiving surface 40 of the cylinder head 4 separating the opening 41*a* pair from the opening 41*b* pair. Preferably, the spacing between the two opening pairs is equal to or greater than the transverse dimension of an exhaust orifice.

The invention claimed is:

1. An external hot source engine comprising:

at least one cylinder, a piston moving back and forth in the cylinder, a cylinder head defining, with the piston and the cylinder, a working chamber for a working gas, a distribution mounted in the cylinder head and selectively communicating the working chamber with the following resources:

a working gas intake, a cold end of a heat exchanger, a hot end of the heat exchanger, an exhaust wherein the distribution comprises at least one rotary slide valve mounted in rotation in the cylinder head and includes internal passages opening through the side wall thereof by at least one hole which selectively communicates with the working chamber by at least one opening made in the cylinder head.

2. The engine according to claim 1, wherein at least one opening of the cylinder head is capable of communicating with two internal passages of the slide valve which open through the side wall of the slide valve by two circumferentially aligned holes.

3. The engine according to claim 2, wherein said two internal passages are, one, is a passage through which the working gas enters in the working chamber, and the other, is a passage through which the working gas leaves the working chamber.

4. The engine according to claim 1, wherein at the end opposite the hole, the internal passages open through the side wall of the slide valve by orifices which selectively communicate with fixed connectors according to the angular position of the slide valve.

5. The engine according to claim 4, wherein, for each passage, the geometry of the at least one slide valve is such that the orifice is capable of communicating with the corresponding connector when the hole communicates with the working chamber.

6. The engine according to claim 4, wherein, on the at least one slide valve, the at least one hole is axially offset relative to the at least one orifice.

7. The engine according to claim 1, wherein the at least one slide valve comprises a low-pressure slide valve controlling the selective communication of the working chamber with the intake and the exhaust.

8. The engine according to claim 1, wherein the at least one slide valve comprises a high-pressure slide valve controlling the selective communication of the working chamber with the hot and cold ends of the exchanger.

9. The engine according to claim 8, wherein the distribution is arranged so that, at the end of the compression, the working chamber begins to communicate with the cold end of the exchanger when the pressure in the working chamber is lower than the pressure in the exchanger.

10. The engine according to claim 1, wherein the at least one hole comprises two holes, for a same passage, capable of simultaneously communicating with the working chamber, by two openings.

11. The engine according to claim 1, wherein at least one passage comprises two passages leading in parallel to a same resource, capable of simultaneously communicating each with one opening of the cylinder head.

12. The engine according to claim 1, having at least two cylinders, wherein the at least one slide valve includes two orifices circumferentially aligned to selectively communicate with a same connector, and which communicate each with a respective passage associated with a respective one of the cylinders.

13. The engine according to claim 1, wherein the openings are surrounded by a sealing device to close the gap between the peripheral wall of the slide valve and an adjacent surface of the cylinder head all around each opening.

14. An engine drive assembly comprising:

an engine comprising:

at least one cylinder, a piston moving back and forth in the cylinder, a cylinder head defining, with the piston and the cylinder, a working chamber for a working gas, a distribution mounted in the cylinder head and selectively communicating the working chamber with the following resources:

a working gas intake, a cold end of a heat exchanger, a hot end of the heat exchanger, an exhaust the distribution comprising at least one rotary slide valve mounted in rotation in the cylinder head and includes internal passages opening through the side wall thereof by at least one hole which selectively communicates with the working chamber by at least one opening made in the cylinder head, and the heat exchanger comprises a heat receiving path extending between the cold end and the hot end selectively connected to the working chamber at the end of a compression phase and at the beginning of an expansion phase, respectively.

15. The assembly according to claim 14, wherein the heat exchanger is of the countercurrent type.

16. The assembly according to claim 14, wherein the heat exchanger comprises a heat yielding path traveled by the exhaust gases of an internal combustion engine.

17. The assembly according to claim 14, wherein the heat exchanger comprises a heat yielding path traveled by a fluid reheated with solar energy.

18. The assembly according to claim 14, wherein at least one opening of the cylinder head is capable of communicating with two internal passages of the slide valve which open through the side wall of the slide valve by two circumferentially aligned holes.

19. The assembly according to claim 14, wherein said two internal passages are, one, is a passage through which the working gas enters in the working chamber, and the other, is a passage through which the working gas leaves the working chamber.

20. The assembly according to claim 14, wherein at the end opposite the holes, the internal passages open through the side wall of the slide valve by orifices which selectively communicate with fixed connectors according to the angular position of the slide valve.

* * * * *